US009702608B2

(12) United States Patent
Oh et al.

(10) Patent No.: US 9,702,608 B2
(45) Date of Patent: Jul. 11, 2017

(54) REFRIGERATOR INCLUDING ICE CRUSHING MEMBER WITH POWER TRANSMISSION UNITS

(75) Inventors: Seunghwan Oh, Changwon-si (KR); Bongjin Kim, Changwon-si (KR); Seongjae Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 13/580,384

(22) PCT Filed: Feb. 17, 2011

(86) PCT No.: PCT/KR2011/001047

§ 371 (c)(1),
(2), (4) Date: Aug. 22, 2012

(87) PCT Pub. No.: WO2011/105718

PCT Pub. Date: Sep. 1, 2011

(65) Prior Publication Data

US 2012/0304680 A1 Dec. 6, 2012

(30) Foreign Application Priority Data

Feb. 23, 2010 (KR) ..... 10-2010-0016033

(51) Int. Cl.
*F25C 5/02* (2006.01)
*F25C 5/18* (2006.01)
(Continued)

(52) U.S. Cl.
CPC ..... *F25C 5/046* (2013.01); *F25C 5/005* (2013.01); *F25C 2400/10* (2013.01);
(Continued)

(58) Field of Classification Search
CPC .... F25C 5/046; F25C 5/043; F25C 2305/022; F25C 5/005; F25C 2700/02;
(Continued)

(56) References Cited

U.S. PATENT DOCUMENTS 5,737,968 A * 4/1998 Hardey et al. ..... 74/421 A
6,425,259 B2 7/2002 Nelson et al.
(Continued)

FOREIGN PATENT DOCUMENTS

CN 101379353 A 3/2009
EP 2 151 644 A1 2/2010
(Continued)

OTHER PUBLICATIONS

International Search Report dated Nov. 22, 2011 for Application No. PCT/KR2011/001047, with English Translation, 4 pages.
(Continued)

*Primary Examiner* — Ryan J Walters
*Assistant Examiner* — Joseph Trpisovsky
(74) *Attorney, Agent, or Firm* — Fish & Richardson P.C.

(57) ABSTRACT

A refrigerator includes a storage room, a door for opening and shutting the storage room, and an ice storage unit. The refrigerator also includes a crushing member, which is rotatably provided at the ice storage unit, and a driving unit, which provides rotational power for the crushing member and includes a rotary shaft to be rotated in a first direction. The refrigerator further includes a first power transmission unit, which is coupled with the rotary shaft and is rotated in a second direction, and a second power transmission unit, which is separably coupled with the first power transmission unit and transmits the power of the first power transmission unit to the crushing member.

9 Claims, 10 Drawing Sheets

(51) Int. Cl.

| | |
|---|---|
| ***F25C 1/00*** | (2006.01) |
| ***F25C 1/22*** | (2006.01) |
| ***F25C 5/04*** | (2006.01) |
| ***F25C 5/00*** | (2006.01) |
| *F25D 23/04* | (2006.01) |

(52) U.S. Cl.
CPC ..... *F25C 2500/02* (2013.01); *F25C 2700/02* (2013.01); *F25D 23/04* (2013.01)

(58) Field of Classification Search
CPC .. F25C 2500/02; F25C 2400/10; F25C 5/002; F25C 5/007; F25C 5/02
USPC ..... 62/320, 344, 135, 137, 340
See application file for complete search history.

(56) References Cited

U.S. PATENT DOCUMENTS

| | | | | |
|---|---|---|---|---|
| 2007/0074527 | A1* | 4/2007 | Lee | F25C 5/005 62/344 |
| 2008/0156018 | A1* | 7/2008 | Lee et al. | 62/320 |
| 2008/0156826 | A1* | 7/2008 | Kim et al. | 221/258 |
| 2009/0064703 | A1 | 3/2009 | Kim et al. | |
| 2009/0133428 | A1* | 5/2009 | An et al. | 62/320 |
| 2011/0146324 | A1* | 6/2011 | Lee | F25C 5/005 62/344 |
| 2011/0239798 | A1* | 10/2011 | Ramirez et al. | 74/412 R |

FOREIGN PATENT DOCUMENTS

| | | | |
|---|---|---|---|
| EP | 2339273 | | 6/2011 |
| KR | 10-2006-0133867 | A | 12/2006 |
| KR | 10-2007-0005852 | A | 1/2007 |
| KR | 10-0663650 | B1 | 1/2007 |
| KR | 10-0710640 | B1 | 4/2007 |
| KR | 10-2007-0103243 | A | 10/2007 |
| KR | 10-2009-0054088 | | 5/2009 |
| WO | WO 2007/120015 | A1 | 10/2007 |
| WO | 2009/057888 | | 5/2009 |

OTHER PUBLICATIONS

Office Action issued in Korean Application No. 10-2010-0016033 on Dec. 1, 2015, 3 pages.
Extended European Search Report issued in European Application No. 11747608.5 on Feb. 15, 2016, 7 pages.

* cited by examiner

REFRIGERATOR INCLUDING ICE CRUSHING MEMBER WITH POWER TRANSMISSION UNITS

CROSS REFERENCE TO RELATED APPLICATIONS

This application is a U.S. National Phase Application under 35 U.S.C. §371 of International Application PCT/KR2011/001047, filed on Feb. 17, 2011, which claims the benefit of Korean Application No. 10-2010-0016033, filed on Feb. 23, 2010, the entire content of each application is hereby incorporated by reference.

BACKGROUND OF THE INVENTION

1. Field of the Invention

Embodiments of the present invention relate to an ice bank and a refrigerator including the ice bank.

2. Description of the Related Art

In general, refrigerators are apparatuses that can keep food fresh for a predetermined period by cooling a storage chamber, that is, a freezing compartment or a cool chamber while repeating a refrigeration cycle. The refrigeration cycle includes a compressor, a condenser, an expansion unit, and an evaporator.

The refrigerators include a main body that forms storage spaces and doors that selectively close the main body. Reserves are received in the storage spaces and a user can open the doors to take out the reserves.

Further, the refrigerators are equipped with an ice machine that manufactures ices and a dispenser through which the ices manufactured by the ice maker is taken out. The ice machine may be disposed in the refrigerator door.

According to the refrigerators of the related art, when the ice machine is disposed in the refrigerator door, there is a problem in that the storage space of the storage room reduces as much as the size of the ice machine. Therefore, the thickness of the ice machine is limited to a predetermined width and it cannot increase to the predetermined width or more not to reduce the storage space.

On the contrary, there is a problem in that the amount of ice that can be stored is limited, when the ice machine, particularly, the ice bank where the ices are stored is formed in a small size in consideration of the storage space of the storage room.

Further, a driving unit and power transmission units are provided for the ice bank to take out the ices, but there is a problem in that the ice storage space of the ice bank is reduced by the volumes of the driving unit or the power transmission units.

SUMMARY OF THE INVENTION

The present invention has been made in an effort to provide a refrigerator in which a wide ice storage space of an ice bank is ensured.

Further, the preset invention provides a refrigerator in which power transmission units that transmit power from a driving unit of an ice bank to a crushing member into two or more parts.

A refrigerator according to an aspect of the present invention includes: a storage room in which a storage space is formed; a door that opens/closes the storage room; an ice storage unit that is provided at the storage room or the door and in which an ice storage space is formed; a crushing member that is rotatably provided at the ice storage unit and crushes ices stored in the ice storage space; a driving unit that provides a rotational force to the crushing member and has a rotary shaft rotating in a first direction; a first power transmission unit that is fitted on the rotary shaft and rotates in a second direction; and a second power transmission unit that is separably coupled to the first power transmission unit and transmits power of the first power transmission unit to the crushing member.

An ice bank of a refrigerator according to another aspect of the present invention includes: a case in which an ice storage space is formed; a housing that is provided at one side of the case and receives a crushing member that crushes ices stored in the ice storage space; a driving unit that provides a driving force to the crushing member; a first power transmission unit that changes the rotational direction of the driving unit; and a second power transmission unit that is coupled to the first power transmission unit and includes at least one power transmission member, in which the driving unit and the first power transmission unit are separably coupled to the housing.

A refrigerator according to another aspect of the present invention includes: a storage room in which a storage space is formed; a door that opens/closes the storage room; an ice storage unit that is separably provided at the door and in which an ice storage space is formed; a crushing member that is provided in the ice storage unit and selectively crushes ices stored in the ice storage space; a driving unit that is provided outside the ice storage unit, provides a driving force, and has a first power transmission unit; and a second power transmission unit that is coupled to the front or the rear of the crushing member and selectively coupled to the driving unit.

DETAILED DESCRIPTION OF THE PREFERRED EMBODIMENTS

Detailed exemplary embodiments of the present invention will be described hereafter with reference to the drawings. However, the spirit of the present invention is not limited to the exemplary embodiments and other exemplary embodiments may be proposed by those understanding the spirit of the present invention without departing from the spirit.

Figure 1:
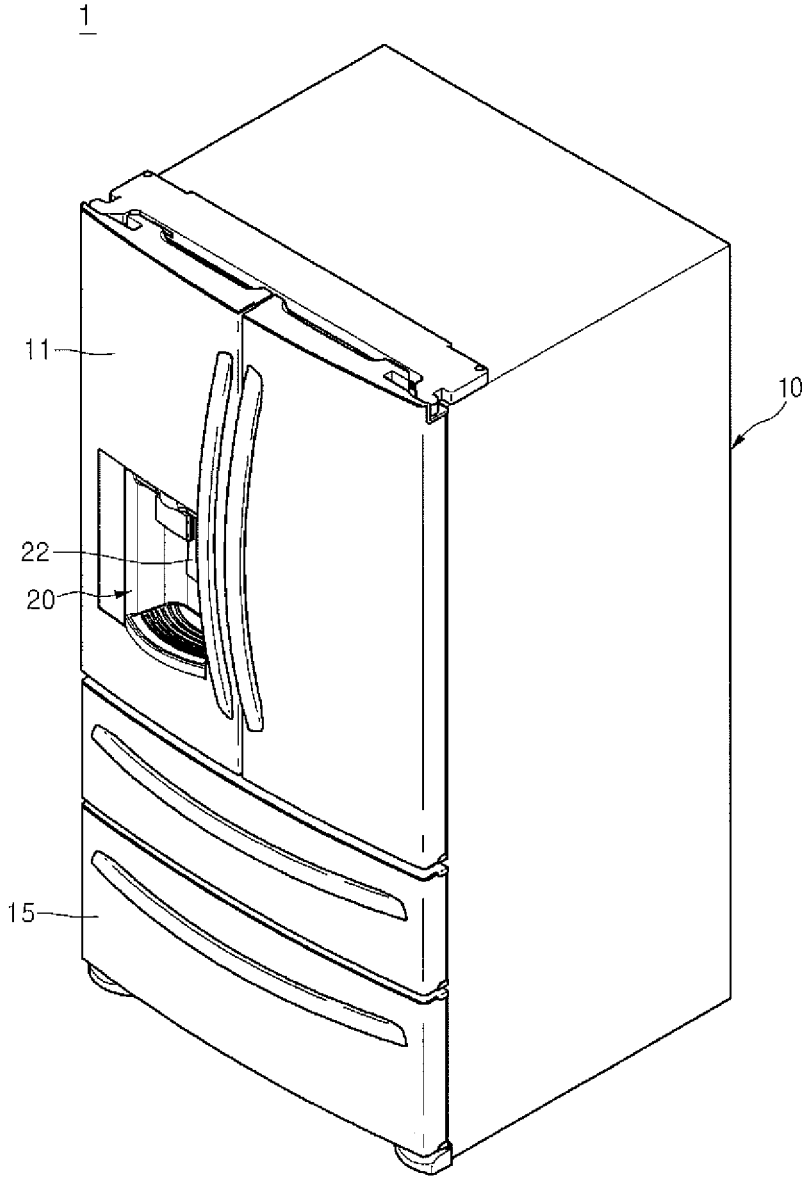
FIG. 1 is a perspective view of a refrigerator according to a first exemplary embodiment of the present invention.
Figure 2:
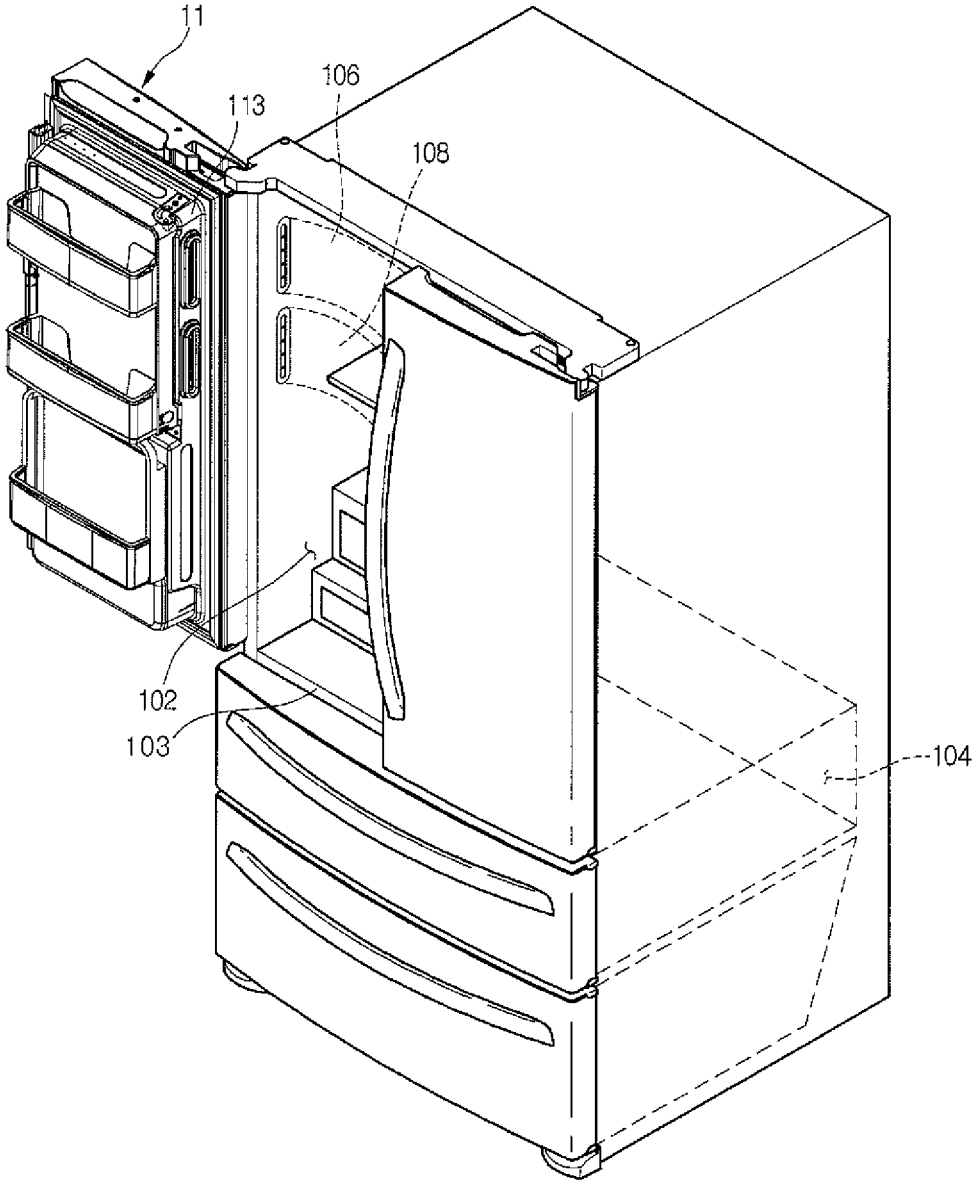
FIG. 2 is a perspective view showing the refrigerator according to the first exemplary embodiment, with the cool chamber door open.

FIG. 1 is a perspective view of a refrigerator according to a first exemplary embodiment of the present invention and FIG. 2 is a perspective view showing the refrigerator according to the first exemplary embodiment, with the cool chamber door open.

Referring to FIGS. 1 and 2, a refrigerator 1 according to the first exemplary embodiment of the present invention includes a cabinet 10 forming the external shape and refrigerator doors 11 and 15 movably connected to the cabinet 10.

A storage room for storing food is formed in the cabinet 10. The storage room includes a cool chamber 102 and a freezing compartment 104 positioned under the cool chamber 102. The cool chamber 102 and the freezing compartment 104 may be separated by a partition 103.

That is, a bottom-freezer type of refrigerator in which a cooling chamber is disposed above a freezing chamber is described as an example in the present exemplary embodiment. However, it should be understood that the spirit of the present invention may be applied to a top-mount type in which a freezing compartment is formed at the upper portion and a cool chamber is formed at the lower portion or one side-by-side type in which a freezing compartment and a cool chamber are formed at the left and right, in addition to the structure of the refrigerator 1.

The refrigerator doors 11 and 15 include a cool chamber door 11 that opens/closes the cool chamber 102 and a freezing compartment door 15 that opens/closes the freezing compartment 104.

The cool chamber door 11 includes a plurality of doors disposed at the left and right. The plurality of doors may be rotatably coupled to the left and right of the cabinet 10.

The freezing compartment door 15 includes a plurality of doors disposed at the upper and lower portions. The plurality of doors may be drawn forward from the cabinet 10.

The cool chamber door 11 is equipped with a dispenser 20 through which water or ices are taken out. The dispenser 20 has a push member 22 that a user can operate to take out water or ices.

Figure 3:
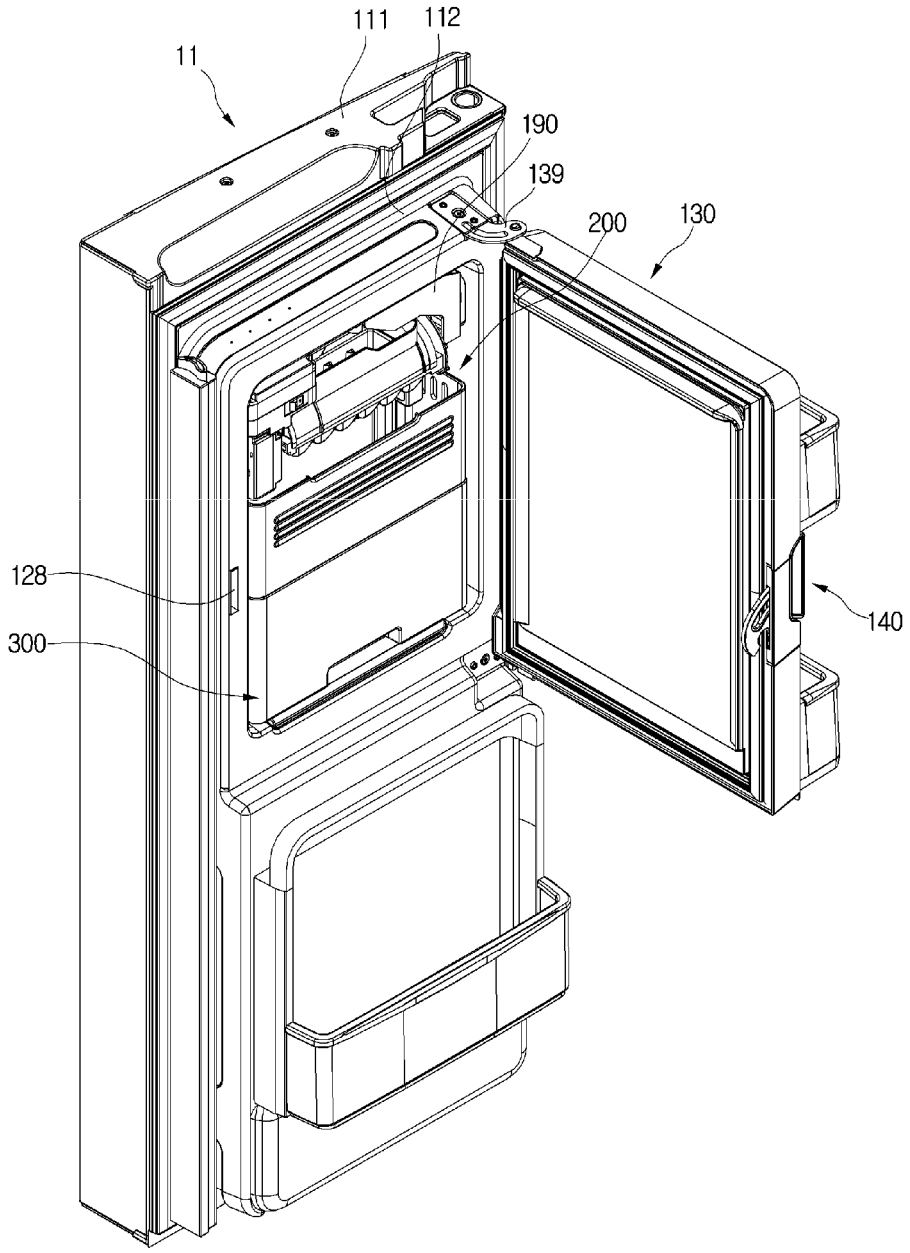
FIG. 3 is a perspective view of the cool chamber door according to the first exemplary embodiment of the present invention.
Figure 4:
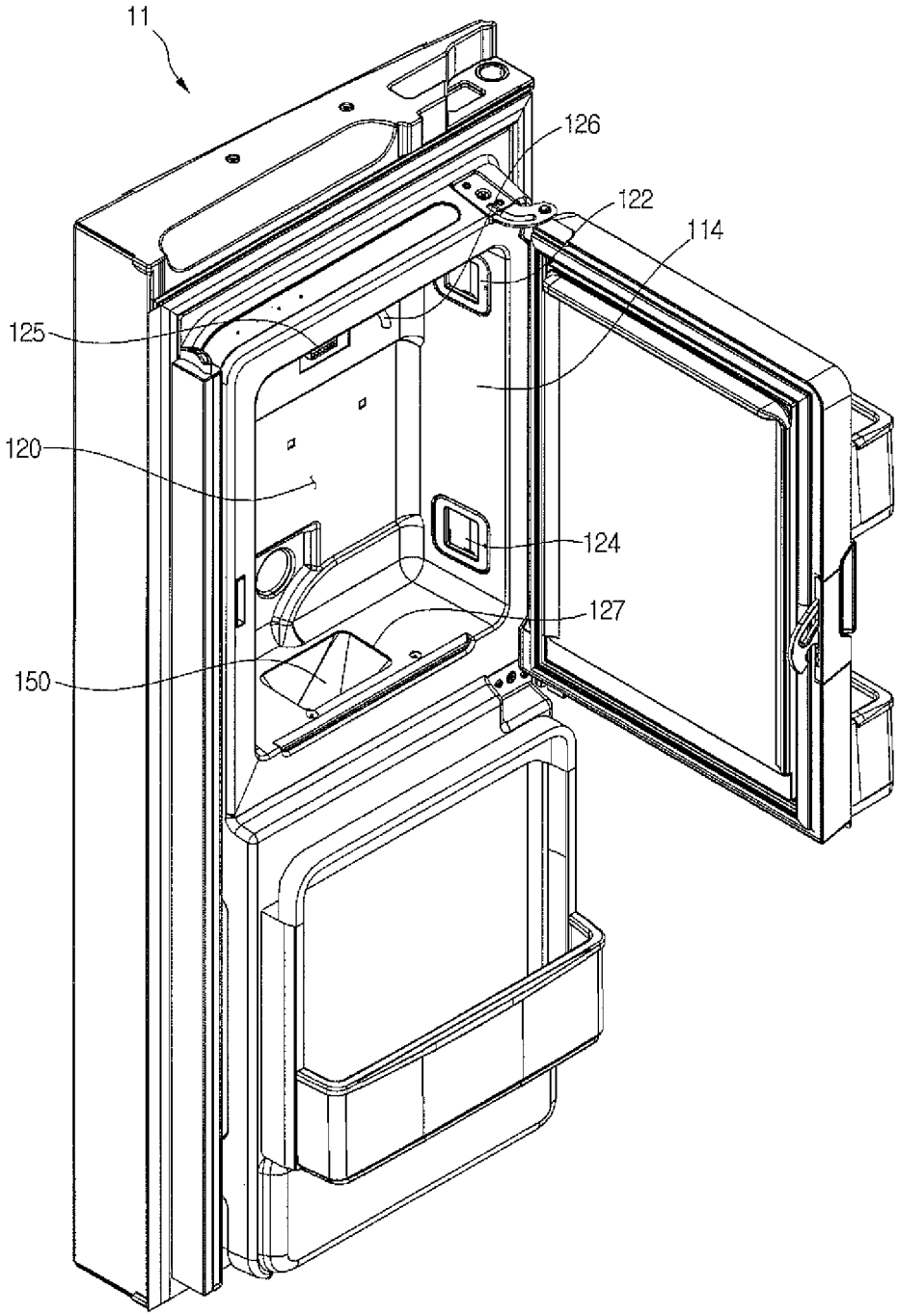
FIG. 4 is a perspective view of the cool chamber door with an ice-making assembly removed according to the first exemplary embodiment of the present invention.

FIG. 3 is a perspective view of the cool chamber door according to the first exemplary embodiment of the present invention and FIG. 4 is a perspective view of the cool chamber door with an ice-making assembly removed according to the first exemplary embodiment of the present invention.

Referring to FIGS. 3 and 4, the cool chamber door 11 includes an outer case 111 forming the front external appearance and a door liner 112 coupled to the outer case 111. The door liner 112 forms the rear side of the cool chamber door 11.

The door liner 112 forms an ice compartment 120. An ice-making assembly 200 for making and storing ices is disposed in the ice compartment 120. Further, the ice compartment 120 is opened/closed by an ice compartment door 130. The ice compartment door 130 is rotatably connected to the door liner 112 by hinges 139.

The ice compartment door 130 is equipped with a handle 140 that is fitted in the door liner 120, when the ice compartment door 130 closes the ice compartment 120.

A handling fitting portion 128 where a portion of the handle 140 is fitted is formed at the door liner 120. The handle fitting portion 128 receives a portion of the handle 140.

The cabinet 10 includes a main body supply duct 106 for supplying cold air to the ice compartment 120 and a main body recovery duct 108 for recovering cold air from the ice compartment 120. The main body supply duct 106 and the main body recovery duct 108 may communicate with a space where an evaporator (not shown) is positioned.

The cool chamber door 11 includes a door supply duct 122 that supplies the cold air in the main body supply duct 106 to the ice compartment and a door recovery duct 124 that recovers the cold air in the ice compartment 120 to the main body recovery duct 108.

The door supply duct 122 and the door recovery duct 124 are extended from an outer wall 113 of the door liner 110 to an inner wall 114 forming the ice compartment 120.

The door supply duct 122 and the door recovery duct 124 are vertically disposed, with the door supply duct 122 above the door recovery duct 124. However, it should be understood that the positions of the door supply duct 122 and the door recovery duct 124 are not limited in the present exemplary embodiment.

With the cool chamber door 11 closing the cool chamber 102, the door supply duct 122 communicates with the main body supply duct 106 and the door recovery duct 124 communicates with the main body recovery duct 108.

Further, a cold air duct 190 that guides the cold air flowing through the door supply duct 122 to the ice-making assembly 200 is disposed in the ice compartment 120. A flow path through which the cold air can flow is formed in the cold air duct 190 and the cold air flowing through the cold air duct 190 is supplied to the ice-making assembly 200.

Since the cold air can be concentrated to the ice-making assembly 200 by the cold air duct 190, ices can be quickly made.

The cool chamber door 11 has a connector 125 for supplying power to the ice-making assembly 200. The connector 125 is exposed to the ice compartment 120. Further, the cool chamber door 11 has a water supply pipe 126 for supplying water to the ice-making assembly 200.

The water supply pipe 126 is disposed between the outer case 111 and the door liner 112, with one end positioned at the upper portion in the ice compartment 120 through the door liner 112.

An opening 127 through which ices are discharged is formed at the lower portion of the inner wall 114. Further, an ice duct 150 that communicates with the opening 127 is formed at the bottom of the ice compartment 120.

Meanwhile, although it was described in the present exemplary embodiment that the ice compartment 120 and the ice-making assembly 200 are provided at the cool chamber door 11, the same configuration may be provided in the cool chamber 102.

Figure 5:
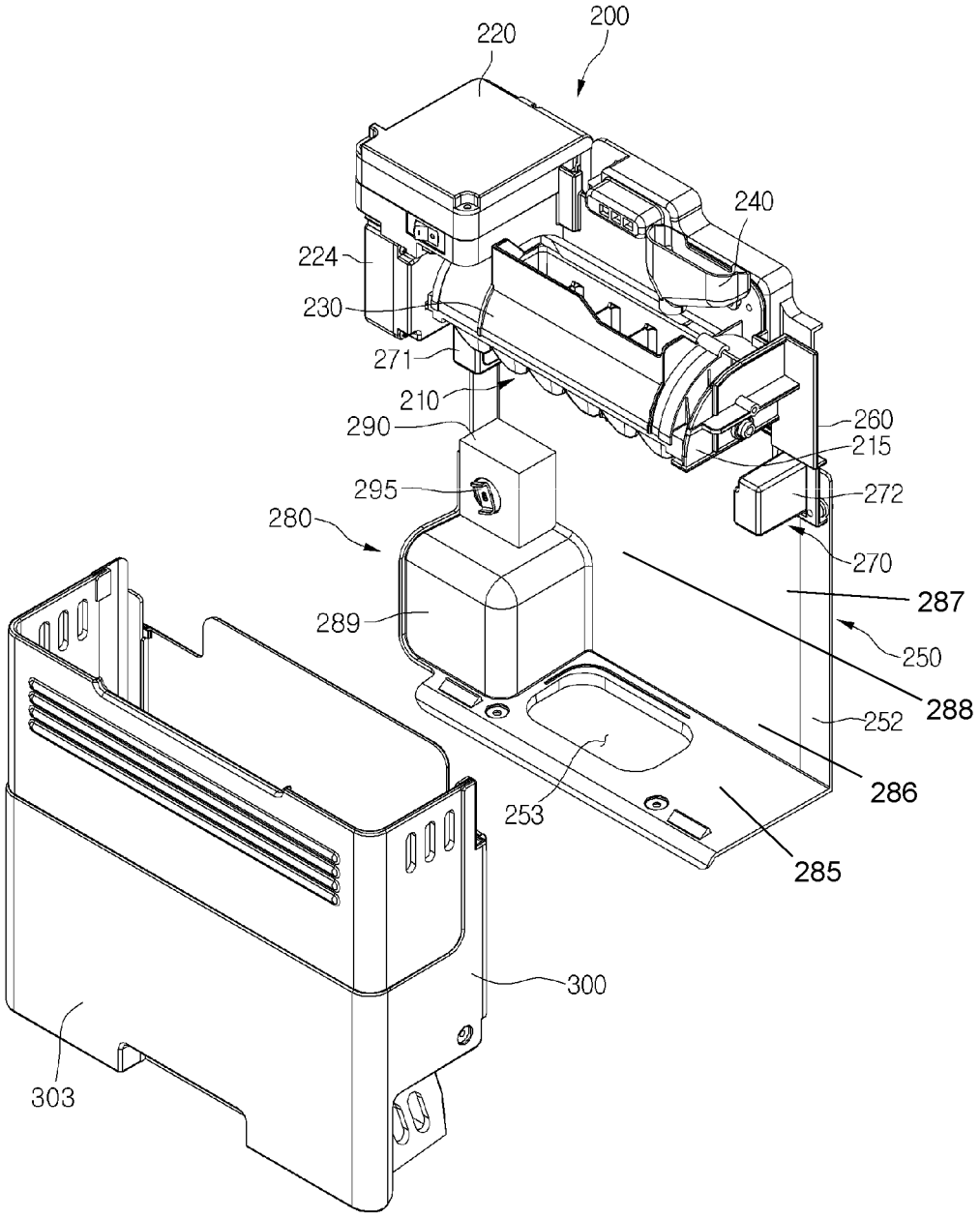
FIG. 5 is an exploded perspective view of an ice-making assembly according to the first exemplary embodiment of the present invention.

FIG. 5 is an exploded perspective view of an ice-making assembly according to the first exemplary embodiment of the present invention.

Referring to FIG. 5, the ice-making assembly 200 according to the first exemplary embodiment of the present invention includes an ice maker 210 that defines a space where ice is made and supports the ice made, a driving source 220 that provides power for automatically rotating the ice maker 210 to separate ices from the ice maker 210, and a gear box 224 that transmits the power of the driving source 220 to the ice maker 210.

Further, the ice-making assembly 200 includes a cover 230 that covers the ice maker 210 to prevent water from overflowing, when supplying water to the ice maker 210, and a water guide 240 that guides the water supplied from the water supply pipe 126 to the ice maker 210.

Further, the ice-making assembly 200 includes a support mechanism 250 having a seat where the ice maker 210 is seated, an ice bank 300 that is an "ice storage" storing ices separated from the ice maker 210, an ice-full sensor 270 that senses the full of ice in the ice bank 300, and a motor assembly 280 that is selectively connected to the ice bank 300.

In detail, the ice support mechanism 250 includes a first support 252 and a second support 260 coupled to the first support 252.

The first support 252 is seated in the ice compartment 120. The motor assembly 280 is mounted on the first support 252. Further, an ice opening 253 through which the ices discharged from the ice bank 300 pass is formed at the bottom of the support 252. The ice bank 300 is seated on the first support 252.

The motor assembly 280 includes a motor unit 281 (see FIG. 7) that is a "driving unit" received inside a motor cover 289, and a motor gear box 290 that is provided above the motor unit 281.

At least one power transmission unit that transmits power of the motor unit 281 is received in the motor gear box 290. Further, a first fitting portion 295 that is fitted in the ice bank 300 protrudes forward from the motor gear box 290.

When the ice bank 300 is seated on the first support 252, the motor assembly 280 is connected with the ice bank 300. In the present exemplary embodiment, the state with the ice bank 300 seated on the first support 252 means the state with the ice bank 300 received in the ice compartment 120.

The ice-full sensor 270 is disposed at the second support 260 at a predetermined distance from the ice maker 210. The ice-full sensor 270 is positioned under the ice maker 210.

The ice-full sensor 270 includes a transmitting unit 272 that transmits a signal and a receiving unit 272 that is spaced from the transmitting unit 271 and receives the signal from the transmitting unit 271.

The transmitting unit 271 and the receiving unit 272 are positioned in the internal space of the ice bank 300, with the ice bank 300 seated on the first support 252.

The ice support mechanism 250 includes a first portion 287 and a second portion 285. The motor gear box 290 is installed on a surface 288 of the first portion 287 and is located on the surface 288 below the motor gear box 290. The second portion 285 extends horizontally from a lower portion 286 of the first portion 287. The second portion 285 defines the ice opening 253.

Figure 6:
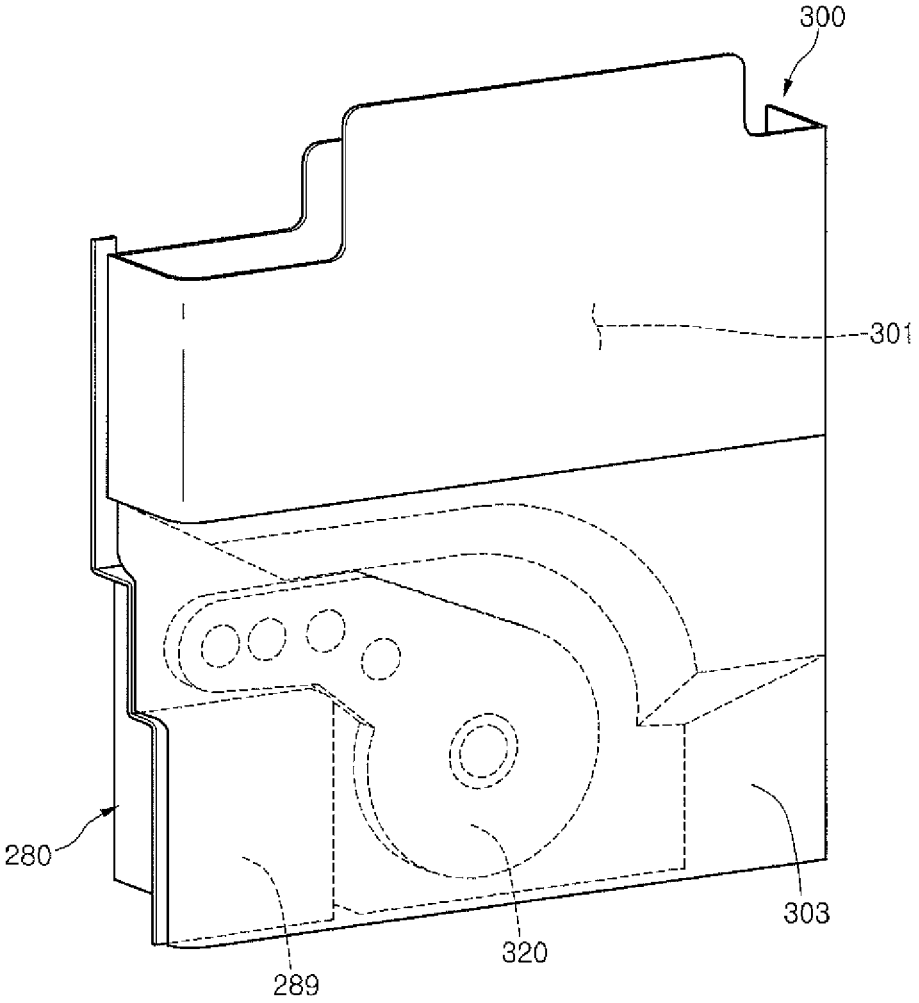
FIG. 6 is a perspective view of an ice bank according to an exemplary embodiment of the present invention.
Figure 7:
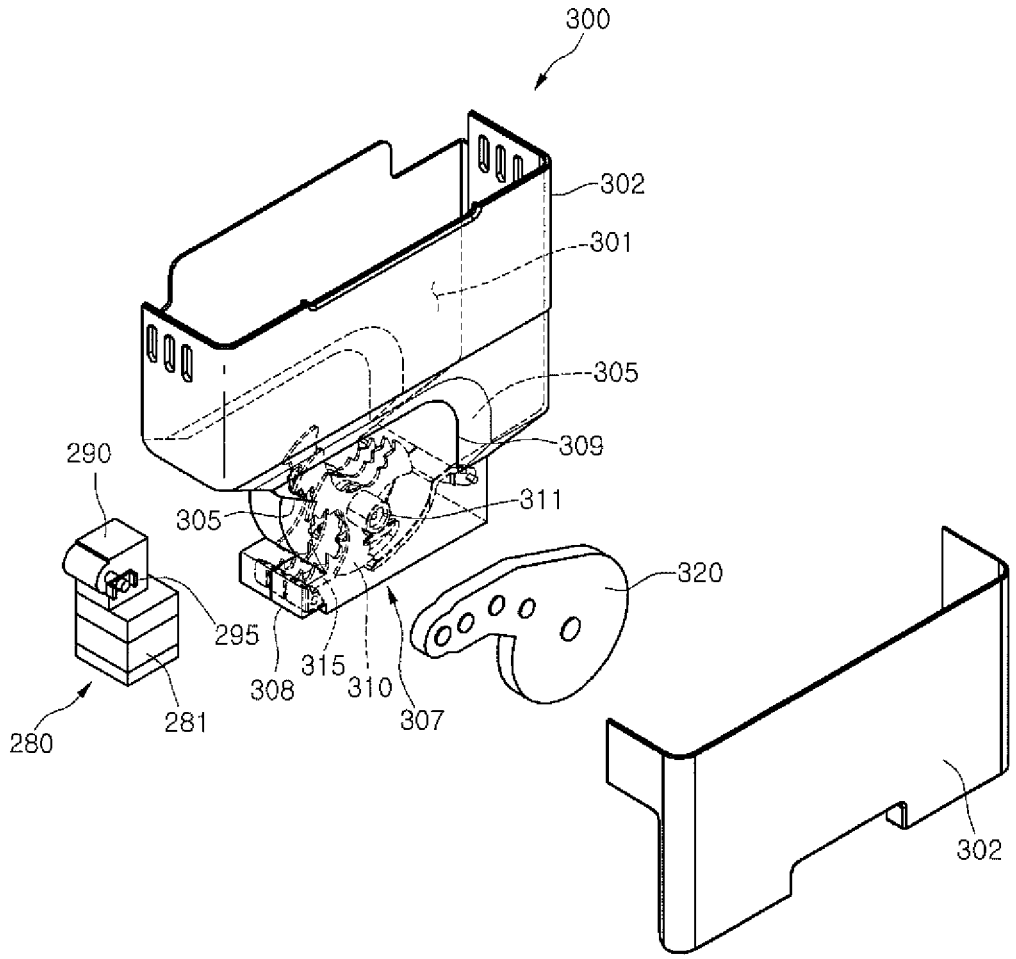
FIG. 7 is an exploded perspective view of the ice bank according to the first exemplary embodiment of the present invention.
Figure 8:
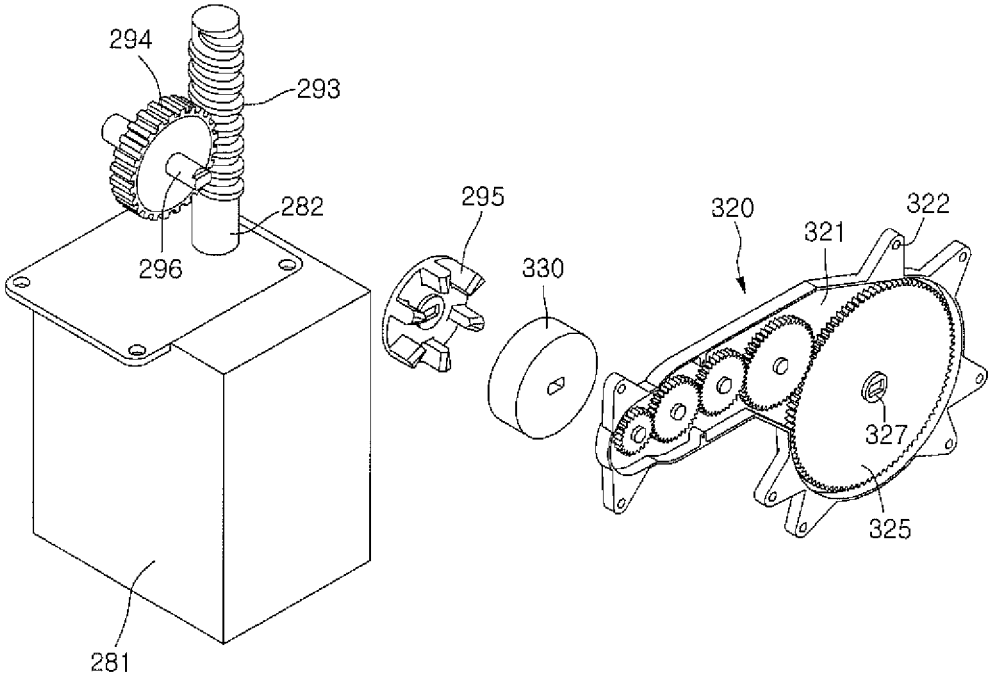
FIG. 8 is a view showing the coupling relationship between a motor assembly and a bank gear box according to the first exemplary embodiment of the present invention.

FIG. 6 is a perspective view of an ice bank according to an exemplary embodiment of the present invention, FIG. 7 is an exploded perspective view of the ice bank according to the first exemplary embodiment of the present invention, and FIG. 8 is a view showing the coupling relationship between a motor assembly and a bank gear box according to the first exemplary embodiment of the present invention.

Hereinafter, the direction indicated by "forward" means the direction in which an ice storage cover 303 is positioned and the direction indicated by "rearward" may be defined as the opposite direction to the ice storage cover 303 from a case 302, as shown in FIG. 7.

Referring to FIGS. 6 to 8, the ice bank 300 according to the first exemplary embodiment includes the case 302 forming an ice storage space 301 and a housing 307 provided under the case 302 and receiving crushing members.

The case 302 has an inclined surface 305 that is inclined downward such that the ices stored in the ice storage space 301 easily drop. The inclined surface 305 may be formed at both sides of the case 302.

Further, the housing 307 extends downward from the lower end of the inclined surface 305. By this configuration, the housing 307 can be formed to have a smaller width than that of the case 302.

That is, as shown in FIG. 7, the housing 307 has a first recession 308 extending to have a recessed width under the case 302 and a second recession 309 concavely extending in the direction in which the thickness of the case 302 decreases, in view of the shape of the housing 307.

The crushing members include a fixed blade 315 fixed in the housing 307, a rotary blade 310 disposed close to one side of the fixed blade 315 and rotatably operating, and a blade rotary shaft 311 providing the rotation center of the rotary blade 310.

A plurality of fixed blades 315 and rotary blades 310 are provided, respectively, and may be disposed alternately ahead of and behind each other.

The bank gear box 320 that transmits a driving force for rotation of the rotary blade 310 is provided ahead of the crushing members. The bank gear box 320 is coupled to the motor gear boxy 290, when the ice bank 300 is seated in the ice compartment 120.

The motor assembly 280 includes the motor unit 281 including a rotator (not shown) and a stator (not shown) to generate a rotational force, and the motor gear box 290 that is provided above the motor unit 281 and transmits the power of the motor unit 281 to the bank gear box 320.

The motor gear box 290 and the bank gear box 320 may be called a "first power transmission unit" and a "second power transmission unit", in view that they transmit the power of the motor unit 281 to the crushing members.

Further, the motor gear box 290 may be disposed at one side of the recession 308 of the housing 307. That is, a space where at least a portion of the motor gear box 290 is arranged can be ensured by the concave shape of the housing 307.

Accordingly, there is an effect that it is possible to prevent the thickness of the ice-making assembly 200 from being increased by the motor assembly 280.

In detail, the motor gear box 290 includes worm gears 293 and 294 that are fitted on a motor rotary shaft 282 extending upward from the motor unit 281. The motor rotary shaft 282 can be rotated by the rotation force generated by the motor unit 281.

The worm gears 293 and 294 include a worm 293 fitted on the motor rotary shaft 282 and a worm wheel 294 thread-fastened to the worm 293. The worm 293 is fitted on the outer circumferential surface of the motor rotary shaft 282 and rotates with the motor rotary shaft 282.

As the worm 293 rotates, the worm wheel 294 co-operates. The worm wheel 294 may rotate perpendicular to the rotational direction of the worm 293 by the structural features of the worm gears 293 and 294.

That is, when the motor rotary shaft 282 rotates in a first direction, the worm wheel 294 may be considered as rotating in a second direction perpendicular to the first direction.

A gear rotary shaft 296 providing a rotation center of the worm wheel 294 is provided at the center portion of the worm wheel 294. The gear rotary shaft 296 extends forward from the worm wheel 294 and may be coupled to the bank gear box 320.

A first fitting portion 295 is coupled to the gear rotary shaft 296. The first fitting portion 295 may be exposed to the outside of the motor gear box 290.

For the convenience of description, the gear rotary shaft 296 may be called a "first rotary shaft" and the blade rotary shaft 311 may be called a "second rotary shaft".

The bank gear box 320 has a second fitting portion 330 that is coupled to the first fitting portion 295. The second fitting portion 330 is coupled to the front of the first fitting portion 295.

The second fitting portion 330 may be separably coupled to the first fitting portion 295. That is, when the ice bank 300 is seated in the ice compartment 120, the second fitting portion 330 is coupled to the first fitting portion 295.

On the contrary, when the ice bank 300 is separated from the ice compartment 120, the second fitting portion 330 may be separated from the first fitting portion 295.

In other words, since the second fitting portion 330 is coupled to the housing 307 by the bank gear box 320, the motor assembly 280 can be considered as being separably coupled to the housing 307.

As described above, the first power transmission unit 290 is disposed at one side of the first recession 308 and fixed to the cool chamber door 11 and the second power transmission unit 320 is provided at the separable ice bank 300 and disposed ahead of the second recession 309.

Further, there is the advantage that it is possible to reduce the width in the front-rear direction of the ice compartment 120, that is, the width in the inside direction of the cool chamber 102 from the cool chamber door 11 by making the first power transmission unit 290 and the second power transmission unit 320 be selectively combined.

In detail, the bank gear box 320 includes a box main body 321 that forms the external appearance, a fitting rib 322 where a predetermined fastening member (not shown) is fitted such that the box main body 321 can be fastened to the front of the housing 307, and a plurality of power transmission gears 325 that is "power transmission members" rotatably provided in the box main body 321.

One of the power transmission gears 325 has a blade fitting portion 327. The blade fitting portion 327 may be fitted on the blade rotary shaft 311 through the center portion of the gear.

The bank gear box 320 may be disposed ahead of the crushing members, when being coupled to the housing 307. That is, the blade rotary shaft 311 can be considered as extending rearward toward the rotary blade 310 from the bank gear box 320.

The ice bank 300 has the ice storage cover 303 that closes the front of the bank gear box 320, with the bank gear box 320 coupled to the housing 307.

The operations of the motor assembly 280 and the bank gear box 320 according to the configuration described above will be briefly described.

When a rotational force is generated from the motor unit 281, the motor rotary shaft 282 rotates in one direction and the worm gears 293 and 294 are driven. In this operation, the worm wheel 294 rotates perpendicular to the rotational direction of the motor rotary shaft 282.

That is, while the rotational force of the motor unit 281 is transmitted to the worm gears 293 and 294, the rotational direction changes to be perpendicular.

The rotational force of the worm wheel 294 is transmitted to the first fitting portion 295, the second fitting portion 330, and the power transmission gears 325. As the power transmission gears 325 rotate, the blade fitting portion 327 and the blade rotary shaft 311 can rotate.

As the blade rotary shaft 311 rotates, the rotary blade 310 rotates, and the ices moved into the housing 307 along the inclined surface 305 are crushed between the crushing members and then moved to the ice opening 253.

Further, the crushed ices are discharged through the dispenser 20, after passing through the opening 127 and the ice duct 150.

Another exemplary embodiment will be proposed.

Although the worm gears 293 and 294 are applied as the configuration of the motor gear box 290 in the present exemplary embodiment, unlikely, a bevel gear may be applied. The worm gear and the bevel gear change perpendicularly the rotation direction of the motor rotation shaft 282, correspondingly to each other.

Meanwhile, although the power transmission gears are applied as the configuration of the bank gear box 320, unlikely, a belt pulley type or a timing belt type may be applied as the "power transmission member". All of the gear, belt pulley, and timing belt types can be considered as corresponding to the power transmission member, in view that they transmit the rotational force of the motor unit 281.

The second exemplary embodiment of the present invention will be described hereafter. Since the present exemplary embodiment is different in arrangement of the second power transmission unit, the difference is mainly described and the description and reference numerals used in the first exemplary embodiment is used for the same configurations.

Figure 9:
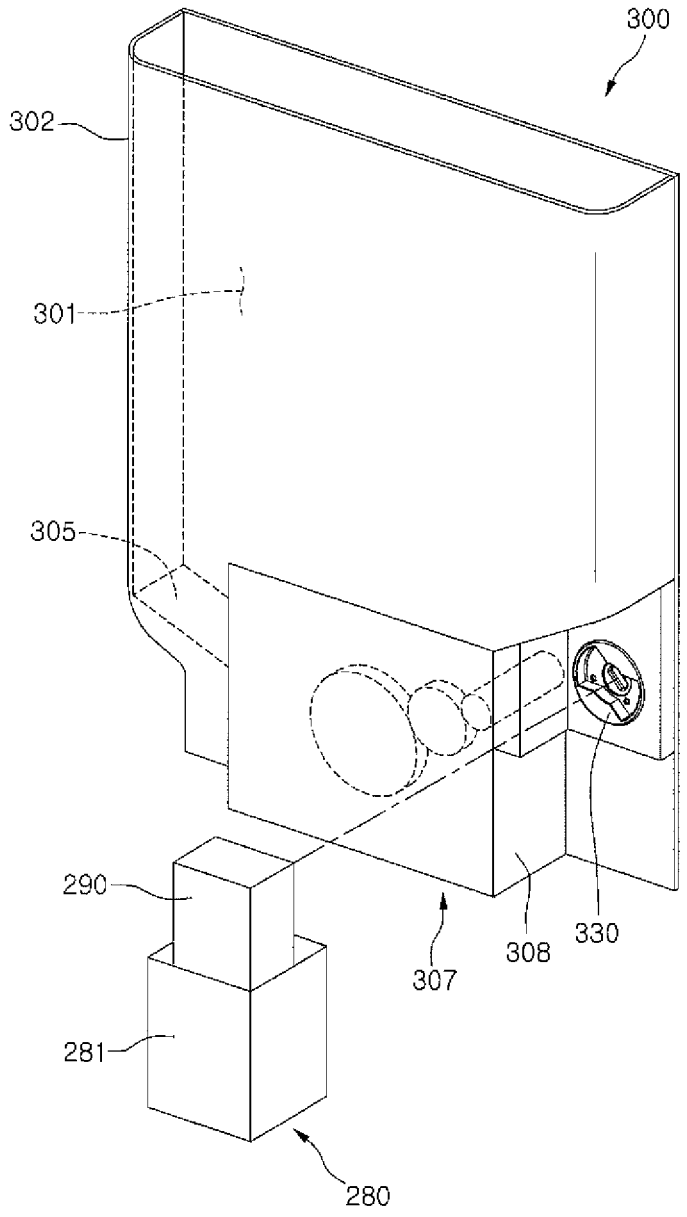
FIGS. 9 and 10 are views showing the coupling relationship between a motor assembly and an ice bank according to a second exemplary embodiment of the present invention.
Figure 10:
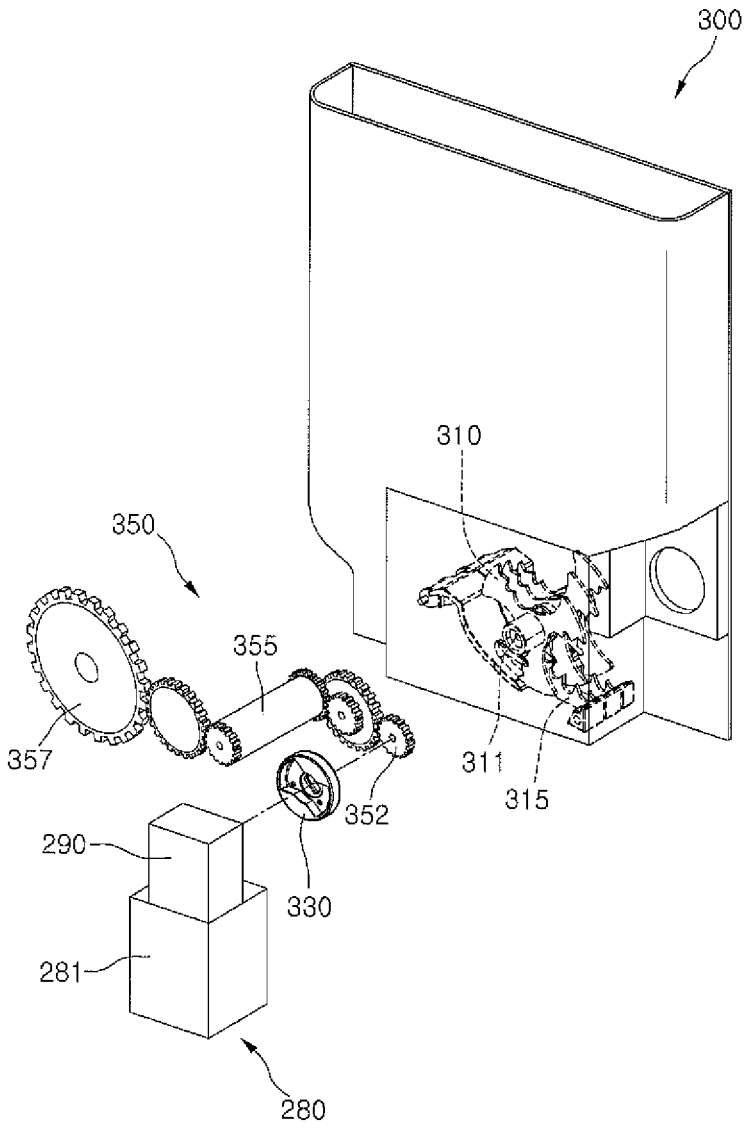

FIGS. 9 and 10 are views showing the coupling relationship between a motor assembly and an ice bank according to a second exemplary embodiment of the present invention. A configuration facing the rear side of the ice bank 300, that is, the rear portion of the ice bank 300 is shown in FIGS. 9 and 10.

Referring to FIGS. 9 and 10, the ice bank 300 according to the second exemplary embodiment of the present invention includes a plurality of power transmission gears 350 disposed in the housing 307. In this configuration, the power transmission gears 350 may be defined as a configuration corresponding to the power transmission gears 325 provided in the bank gear box 320 of the first exemplary embodiment.

Meanwhile, the configuration of the motor assembly 280 is the same as that in the first exemplary embodiment and the description is not provided in this exemplary embodiment.

The second fitting portion 330 coupled to the motor assembly 280 is exposed to the rear side of the ice bank 300. Therefore, when the ice bank 300 is mounted in the ice compartment 120, the second fitting portion 330 can be easily coupled to the motor assembly 280.

In detail, the power transmission gears 350 include a plurality of first gears 352 fitted on the second fitting portion 330, a plurality of second gears 357 spaced rearward from the first gears 352, and a spacer connecting the first gears 352 and the second gears 357.

The power transmission gears 350 can be considered as being coupled to the motor assembly 280, particularly to the left side or the right side of the motor gear box 290, in view of position.

The spacer 355 extends rearward to be long from one side of the first gears 352 such that the second gears 357 can be coupled to the rears of the crushing members. One end and the other end of the spacer 355 may have the shape of gear teeth to cooperate together with the first gears 352 and the second gears 357.

Further, since the rotary blade 310 is disposed ahead of the second gears 357, the blade rotary shaft 311 provided for the rotary blade 310 may extend forward toward the rotary blade 310 from the second gear 357.

According to the configuration of the present exemplary embodiment, the motor assembly 280 is positioned at one side of the first recession 308 and the power transmission gears 350 are positioned in the housing 307.

Further, the motor assembly 280 and the power transmission gears 350 are selectively combined and the power of the motor unit 281 can be easily transmitted to the crushing members.

For example, when the power transmission gears 350 are integrally formed with the motor assembly 280 and coupled to the outer side of the ice bank 300, there is generated a problem in that the space of the ice compartment 120 is required as much as the volume of the power transmission gears 3560, and accordingly, the thickness of the ice compartment 120 increases.

Therefore, the first exemplary embodiment and the second exemplary embodiment have the effect that it is possible to reduce the width of the ice bank by dividing the power transmission unit, which transmits power of the motor unit to the crushing member, into a plurality of parts and disposing the parts at appropriate positions.

Further, there is the advantage that the volume reduced as much as the size of the power transmission unit can be used as an ice storage space.

According to a refrigerator of the present invention, since it is possible to reduce the width of an ice bank by dividing a power transmission unit, which transmits power of a motor unit to crushing members, into a plurality of parts, the industrial applicability is remarkable.

According to a refrigerator of an exemplary embodiment of the present invention, since the volume occupied by power transmission units can be reduced in the width direction of an ice bank, it is possible to ensure a relatively large storage space for storing ices.

Further, since a motor gear box transmitting power of a driving unit and a bank gear box are separably coupled and the size in the width direction of the ice bank can be reduced as much as the size of the bank gear box, it is possible to implement a slim ice bank.

Further, the bank gear box is provided ahead of or behind a crushing member disposed under the ice bank and does not limit the ice storage space.

What is claimed is:

1. A refrigerator comprising:

a storage room that defines a storage space;

a door that opens or closes the storage room and includes an ice compartment;

an ice maker installed within the ice compartment and configured to make ice;

an ice support mechanism including a first support installed in the ice compartment; and an ice bank installed within the ice compartment and configured to store the ice, the ice bank comprising:

a case that defines an ice storage space;

a housing located at a lower side of the case and having a recess that comprises:

a first recess extended concavely from the case in a lateral direction; and a second recess extended concavely from the case in a rear direction;

at least one blade received in the housing and configured to transfer the ice stored in the ice storage space;

a motor unit disposed adjacent to the first recess of the housing, configured to generate power, and having a motor rotary shaft;

a motor gear box coupled to the motor rotary shaft;

a bank gear box disposed at a front side of the second recess, separably coupled to the motor gear box, configured to transmit the power to the at least one blade, and comprising a plurality of gears arranged in the lateral direction; and a cover disposed at a front side of the bank gear box and configured to shield the bank gear box, wherein the first support includes:

a first portion having a surface on which the motor gear box is installed, the first portion extending longitudinally; and a second portion extended from a lower portion of the first portion horizontally configured to receive the ice bank, the second portion having an ice opening into which ice discharged from the ice bank is introduced, and wherein the bank gear box is coupled to the motor gear box based on the ice bank being seated on the second portion of the first support and the bank gear box is separate from the motor gear box based on the ice bank being away from the first support.

2. The refrigerator of claim 1, wherein the motor gear box comprises a worm gear that is fitted on the motor shaft and includes a worm and a worm wheel, wherein the motor shaft and the worm rotates in a first direction and the worm wheel rotates in a second direction.

3. The refrigerator of claim 2, wherein the motor gear box is fixed to the door, and the ice bank and the bank gear box are separably coupled to the door.

4. The refrigerator of claim 2, further comprising:

a first fitting portion that protrudes from the motor gear box; and a second fitting portion that is separably coupled to the first fitting portion, wherein the second fitting portion is coupled to the first fitting portion when the ice bank is mounted on the second portion of the first support.

5. The refrigerator of claim 1, further comprising a water supply pipe that is installed in the ice compartment and supplies water to the ice maker.

6. The refrigerator of claim 1, wherein the case comprises an inclined surface that is inclined downward at both sides of the case.

7. The refrigerator of claim 6, wherein the housing extends downward from a lower end of the inclined surface of the case.

8. The refrigerator of claim 7, wherein:

the first recess concavely extends from the inclined surface in the lateral direction, the second recess concavely extends from the inclined surface in the rear direction, a width of the housing in the lateral direction is smaller than that of the case in the lateral direction, and a thickness of the housing in the rear direction is smaller than that of the case in the rear direction.

9. The refrigerator of claim 1 wherein the plurality of gears rotate in a plane that is parallel to a front of the refrigerator.

* * * * *